United States Patent [19]

Bolsinger et al.

[11] 4,094,324

[45] June 13, 1978

[54] PERFORATED CIGARETTE TIPPING PAPER

[75] Inventors: Otto Bolsinger; Ingolf Seckelmann, both of Herne, Germany

[73] Assignee: Deutsche Benkert GmbH & Co., K.G., Herne, Germany

[21] Appl. No.: 676,984

[22] Filed: Apr. 14, 1976

[30] Foreign Application Priority Data

Jul. 12, 1975 Germany ..... 2531285

[51] Int. Cl.[2] ..... A24D 1/02

[52] U.S. Cl. ..... 131/10 A; 131/15 B

[58] Field of Search ..... 131/15 B, 10 A, 11, 131/10.3, 15 R, 15 A; 93/1 C; 219/384

[56] References Cited

U.S. PATENT DOCUMENTS

| | | | |
|---|---|---|---|
| 3,046,994 | 7/1962 | Schur | 131/15 B |
| 3,475,591 | 10/1963 | Fujii et al. | 131/15 B |
| 3,783,237 | 1/1974 | McArthur | 219/384 |
| 4,035,220 | 7/1977 | Hammersmith | 131/10 A |

FOREIGN PATENT DOCUMENTS

| | | | |
|---|---|---|---|
| 675,076 | 11/1963 | Canada | 131/10 A |
| 938,902 | 10/1963 | United Kingdom | 131/15 B |

*Primary Examiner*—Robert W. Michell
*Assistant Examiner*—V. Millin
*Attorney, Agent, or Firm*—Andrus, Sceales, Starke & Sawall

[57] ABSTRACT

A cigarette tipping paper is formed in a strip with spark-eroded perforations irregularly distributed in one or more zones extending the length of the strip. Unperforated regions are located along the margins of the strip. This cigarette tipping paper is receivable on the exterior of a filter on a filtered cigarette to form a filter tip having a porosity approaching that of the filter alone.

4 Claims, 2 Drawing Figures

PERFORATED CIGARETTE TIPPING PAPER

BACKGROUND OF THE INVENTION

1. Field of the Invention

The present invention relates to perforated tipping papers for cigarettes.

2. Description of the Prior Art

The invention relates to cigarette tipping paper perforated in specific zones and otherwise having the desired quality and finish. The width of this paper corresponds at least to the length of a cigarette-tip to be lined and its length constitutes a multiple of the width. One or more zones are perforated and are disposed in the longitudinal direction of the paper. The perforations pass through the paper and through any coating it may have.

The invention relates to cigarette tipping papers for filter cigarettes, which allow through the perforated zones the intermixing of the smoke with air.

Like the use of tobaccos with a low nicotine content or of nicotine-free additives, the admixture of air leads to a reduction in the harmfulness of cigarette smoke, as a result of the fact that thereby the harmful constituents inhaled by the smoker, e.g. nicotine, tar and carbon monoxide, are reduced in their proportions.

As a rule, such cigarette tipping paper has a width corresponding to the length of two cigarette-tips. This is due to the mode of operation of modern cigarette-manufacturing machines which, firstly, line twice the length of the tip and, subsequently divide this length into two tips. Such cigarette tipping paper can be white, but frequently bears an imitation which lends to its surface a distinct appearance, e.g. that of cork. Furthermore, decorative lines are often applied as desired, or else other ornamentation.

When inhaling the smoke, the smoker draws in additional air which flows through the perforations in the zones of the cigarette tipping paper and through an underlying porous or perforated filter-wrapping paper, so as then to mingle with the smoke in the filter. Satisfactory accomplishment of the admixing of air presupposes, therefore, that the perforations in the cigarette tipping paper and the holes in the filter-wrapping paper remain open.

Perforated tipping papers have been known for a long time. In particular, a cigarette tipping, paper is known which has one or more rows of successive holes (perforations) which are produced, for example, like the perforations in postage stamps. Characteristic of the latter is the predetermined and invariable size, number and arrangement of the perforations. Several rows of perforations running longitudinally along the paper are normally provided side by side at a small distance apart so that they are separated from their associated edge of the cigarette tipping paper by an edging strip which has no rows of perforations.

Such perforation can be effected both by mechanical operation or by applying laser beams.

Normally, i.e., when using non-perforated cigarette tipping paper, a complete surface coating with adhesive is carried out on the cigarette tipping so as to achieve the connection between the cylinder of tobacco and the cigarette filter. One of the disadvantages of the known perforated cigarette tipping paper of the aforementioned type lies in the fact that adhesive can penetrate through its perforations. These adhesive constituents come into contact with machine parts which necessarily contact the lining. Breakdowns soon occur here which halt production. This is unacceptable since modern automatic machinery works at high production rates of, for example up to 4,000 cigarettes per minute.

Moreover, there is the danger of the manufactured filter cigarettes sticking together. This lends to considerable difficulties during the subsequent packaging of the cigarettes, or the manufactured cigarettes become completely unusable.

Nevertheless, it is possible to obviate these disadvantages arising from the use of the perforated cigarette tipping papers of the above-described type. For this purpose there are used gluing rolls which apply the glue only to a fraction of the width of the cigarette tipping paper and thus leave the rows of holes untouched.

The known perforated cigarette tipping paper has the disadvantage, however, that the intermixing of the cigarette smoke with air is non-homogeneous and incomplete because of the relatively large holes, and consequently, the effectiveness in reducing the harmful smoke constituents is not completely satisfactory.

Furthermore, in many cases it is undesirable to make apparent to the smoker the addition of air to the smoke in the filter, on account of the holes being clearly visible in the cigarette tipping paper.

It has also been shown that, for a given permeability of the filter-wrapping paper, a very substantial reduction in this permeability occurs after the application of the cigarette tipping paper. The extent of this reduction and, therefoe, the degree of effectiveness of the admixture of air to cigarette smoke, is very variable in certain circumstances, depsite equal perforations.

Accordingly, cigarette tipping papers have been developed in which fresh air is admitted through a plurality of microscopically small holes and there is thus obtained an intensive intermixing of the smoke and a higher degree of effectiveness in reducing the proportion of harmful constituents in the smoke.

In particular, a cigarette tipping paper is known which is porous over the entire surface and in which the porosity is achieved by using a base paper which is porous over the entire surface. Such paper has a coarse-mesh structure, which can be verified by microscopic examination, and is therefore permeable to air. Naturally, considerable difficulties arise in processing and coating such papers.

Because of the base paper, cigarette tipping papers which are porous over the entire surface have necessarily a rough, uneven surface. In this way coatings are produced which are used, for example, for a cork imitation effect and imprints of stripes and ornaments do not have the desired visually satisfactory uniform surface. Cigarette tippings produced from such papers thus leave a qualitatively low-grade impression. Furthermore, such porous base papers do not in most cases satisfy the requirement of opacity.

According to the type of cigarette it is necessary, moreover, to vary the air-permeability of the tipping paper. However, if it is necessary to resort to the use of a base paper which is porous over the entire surface, then such a variation necessitates an alteration in composition during paper manufacture or an alteration of the paper-machine setting. This forces the purchase of relatively large stocks, graded according to paper-mesh size, of cigarette tipping paper of specific porosity and these stocks are often too large to be disposed of for a specific type of cigarette. Moreover, special raw products are required to produce base paper, which is porous over the entire surface, for cigarette tipping, said products being considerably more expensive than conventional raw products.

Finally, necessitated by the production process of such base papers, the difference in porosity is so great both within a batch or between different batches that in certain circumstances it severely impairs the use of such material.

The danger of penetration by glue with the above-mentioned disadvantages cannot be prevented in the case of cigarette tipping paper with a fully porous surface, so that the disadvantages described initially are always present in these papers.

In addition, the porous cigarette tipping paper leads to further processing difficulties, since the cigarette tipping paper is guided and conveyed in the automatic cigarette-making machines partly by means of vacuum. This vacuum cannot be maintained with porous cigarette tipping paper, or only with difficulty, and the failure of the vacuum leads to production stoppages.

Apart from these difficulties, however, it is also impossible to reproduce the action of air-admixture to smoke. On the contrary, sharp variations are apparent.

SUMMARY OF THE PRESENT INVENTION

It is the object of the invention to improve the perforated cigarette tipping paper described at the outset, in that its perforations are practically invisible to the smoker and yet there is achieved a satisfactory degree of effectiveness in reducing the harmful constituents in the cigarette smoke by admixing air, in which case the deviations of air-permeability from a predetermined desired value are less than in the case of perforations made in known manner.

According to the invention this object is achieved in that the perforations are produced by high-tension spark erosion and are arranged at irregular distances apart but are restricted to one or more zones whose length corresponds to the length of the paper and whose width corresponds to a constant fraction of the paper, which is separated from the two edges of the paper by unperforated edge strips.

Tests for the electroerosive treatment of cigarette tipping papers, carried out with the aim of perforating the tipping by spark erosion, show that the perforations thuse formed differ from mechanically produced perforations, or from those produced by laser beams, essentially in that the size of the holes is considerably smaller and that their size and distance apart are irregular. In fact, it is possible to achieve with high-tension spark erosion a permeability to air which makes possible an intensity of intermixing of the smoke with air which corresponds substantially to that of porous cigarette tipping paper.

The zonal disposition of the high-tension spark erosion makes it possible to leave the zones untouched, e.g. with the above-described gluing rolls, and thereby to avoid the penetration of glue and the drawbacks associated therewith.

The formation of the perforations using the high-tension spark-erosion process makes it possible for the holes to be made very much smaller. Accordingly, the intermixing of air is more intensive and the degree of effectiveness in the reduction of harmful constituents in the cigarette smoke is considerably improved. Moreover, the possibility is offered of controlling the air-permeability per unit of area of the cigarette tipping paper within one zone by varying the number or size of the perforations and also, additionally, by varying the zone width and/or by increasing the number of zones and, therefore, of conforming to a desired type of cigarette.

Surprisingly, it has been shown that the reduction in the permeability of a filter-wrapping paper of given porosity by the cigarette tipping according to the invention is very much less than in the case of perforated cigarette tippings of known design. In this way it is possible to make the zone(s) relatively narrow and thereby gain space for the edge strips. The edge strip facing the tobacco filling is able to retain a width which is determined substantially in accordance with the following criteria: Firstly, sufficient overlap must be present, which can amount to 4 mm, for example. Secondly, there can be maintained a distance apart from the point of contact which is highly stressed and, therefore, should not be weakened. Finally, further criteria may require a widening of the edge strip.

The width of the edge strip facing the tip end may be so chosen that the smoker does not touch the zone(s) with his/her lips and cover up perforations.

The electroeroded zones have another remarkable property. The permeability arising therefrom is practically constant. This has particular advantages, since the layout and number of zones, once chosen, leads to practically constant dilution of the cigarette smoke with fresh air. Accordingly, it is also possible to reproduce the degree of effectiveness. This has the advantage that the manufacturer can guarantee specific values more easily than before.

In particular, according to another feature of the invention, the zones are so formed that the perforations have different diameters. Production is also simplified thereby.

One example of embodiment of the invention is illustrated diagrammatically in the drawing, in which:

DETAILED DESCRIPTION OF THE PREFERRED EMBODIMENT

Figure 1:
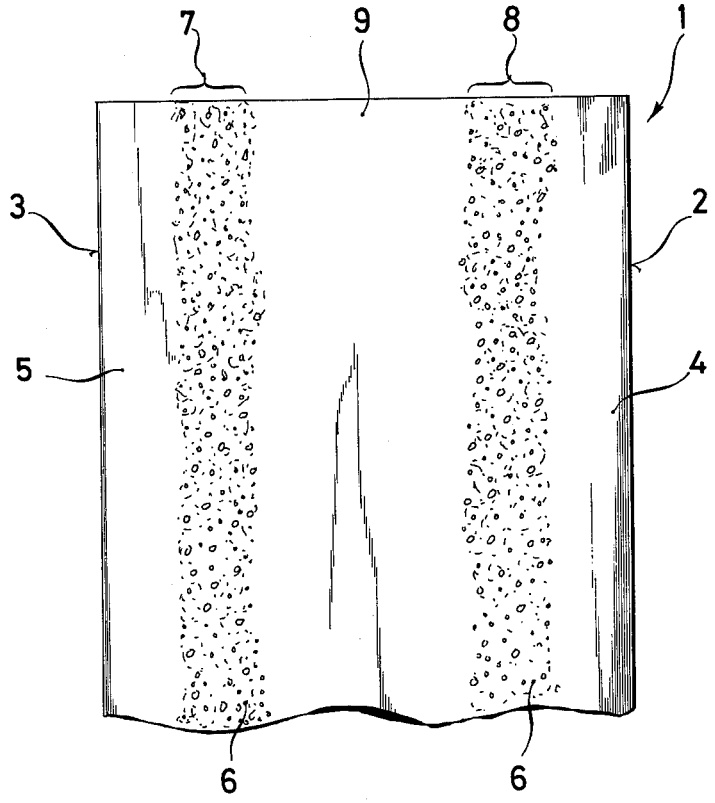
FIG. 1 shows a plan view of a portion of a zonally perforated cigarette tipping paper.

The cigarette tipping paper illustrated in FIG. 1 is a portion from a so-called roll, so that the length of the cigarette-tip lining paper 1 is measured at the two edges 2, 3. The width of the paper 1 corresponds in the embodiment shown to the length of two-cigarette-tips and is measured transversely to the edges 2, 3.

Figure 2:
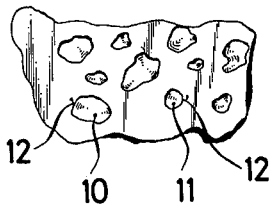
FIG. 2 shows an enlarged cutaway portion from one of the two zones to illustrate the nature of the high-tension spark erosion.

Two unperforated edge strips 4, 5 adjoin the edges 2, 3. The perforations 6 are disposed in two zones 7 and 8. The zones are of irregular width, which is measured in the transverse direction of the cigarette-tip lining paper 1 but corresponds in its mean value in the two zones 7, 8. The length of the zones 7, 8 corresponds to the length of the cigarette tipping paper 1. An unperforated centre strip 9, which is wider than the two edge strips 4, 5, is located between the two zones 7, 8, As FIG. 2 shows, the zonal perforations 10, 11 illustrated therein are of different size. Their boundary lines 12 are irregular, however, and approximately circular. They originate from the electrical breakdown through the paper, which is caused by intermittent discharge between two electrodes. This spark erosion is the result of successive, non-stationary electric discharges spaced apart in time. The perforations 10, 11 produced thereby can be varied in respect to their size, number and distribution in the zones 7, 8. This variation is effected with regard to the particular intermixing and dilution effects desired.

In contrast to the representation in the drawing, in practice the perforations 10, 11 are so minute that normally they are invisible to the naked eye. Consequently, the smoker is also unable to detect the zones 7, 8 and cannot see their boundaries. The zones 7, 8 are visible only when the tipping paper is examined as such and in certain light conditions.

The uniformity of the smoke intermixing is achieved by statistical distribution of the variably sized holes, most of which have a free area and whose diameter is measured in microns.

We claim:

1. In a cigarette having at one end, an air permeable filter having a defined porosity along the exterior thereof, a cigarette tipping paper receivable on the exterior of the filter to form a filter tip having a porosity approaching that of the filter alone, said tipping paper having a width in excess of the length of the filter and a length which is at least as great as the circumference of the filter, said paper having at least one perforated zone which is arranged in the longitudinal direction of the paper and having a width corresponding to a fraction of the width of the paper, said zone being bordered by first and second unperforated edge strips which receive the tobacco containing portion of the cigarette and the lips of the user, respectively, said perforated zone containing a plurality of minute perforations normally invisible to the naked eye and formed by high tension spark erosion, said perforations being irregular in shape, size and location within said zone and present in a sufficient number to provide a porosity to the zone for establishing the porosity of the filter tip inclusive of the tipping paper at that approaching the porosity of the filter alone.

2. The cigarette tipping paper according to claim 1 characterized in that the length of the zone is constant and its width is variable in accordance with the properties of the plurality of perforations.

3. The cigarette tipping paper according to claim 1 having a width in excess of double the length of the cigarette filter, said cigarette tipping paper having a pair of zones separated by an unperforated medial strip.

4. The cigarette tipping paper according to claim 1 wherein the width of the zone varies along the length of the strip.

* * * * *